United States Patent [19]

Cordani et al.

[11] Patent Number: 4,784,785

[45] Date of Patent: Nov. 15, 1988

[54] COPPER ETCHANT COMPOSITIONS

[75] Inventors: John L. Cordani, Waterbury; Raymond A. Letize, West Haven, both of Conn.

[73] Assignee: MacDermid, Incorporated, Waterbury, Conn.

[21] Appl. No.: 139,589

[22] Filed: Dec. 29, 1987

[51] Int. Cl.[4] ..... C09R 13/02

[52] U.S. Cl. ..... 252/79.4; 204/129.75

[58] Field of Search ..... 204/129.75; 252/79.4

[56] References Cited

U.S. PATENT DOCUMENTS

| | | | |
|---|---|---|---|
| 2,982,625 | 5/1961 | Saubestre | 41/42 |
| 4,144,119 | 3/1979 | Dutkewych | 156/659 |
| 4,311,551 | 1/1982 | Sykes | 156/640 |
| 4,404,074 | 9/1983 | Tomaszewshi | 204/129.95 |
| 4,557,811 | 12/1985 | Furst et al. | 204/105 R |
| 4,564,428 | 1/1986 | Furst et al. | 204/107 |

*Primary Examiner*—R. L. Andrews

*Attorney, Agent, or Firm*—St. Onge Steward Johnston & Reens

[57] ABSTRACT

The etching rate of an alkaline ammonium copper etching bath is accelerated by inclusion therein of an etchant accelerating amount of a mixture comprising an ammonium halide, a water-soluble salt containing sulfur, selenium or tellurium in the anion, an organic thio compound containing the group

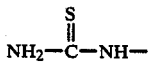

and, optionally, a water-soluble salt of a noble metal (e.g. silver).

32 Claims, No Drawings

COPPER ETCHANT COMPOSITIONS

BACKGROUND OF THE INVENTION

1. Field of the Invention

This invention relates to etchant baths for dissolution of metals and is more particularly concerned with improved methods and compositions for the etching of copper and copper alloys and, in a particular embodiment, with application thereof to the production of printed circuit boards.

2. Description of the Prior Art

The manufacture of printed circuit boards generally begins with a non-conducting substrate such as a phenolic or epoxy-glass sheet to one or both sides of which is laminated a layer of copper foil. A circuit is made by applying an etch resist image in the shape of the desired circuit pattern to the copper foil and subjecting the latter to the action of an etchant bath to etch away all the copper except that covered by the etch resist.

In the processes commonly employed in the art, the copper clad insulating board bearing the etch resist pattern is contacted either by immersion or by spraying with an acidic ferric chloride, cupric chloride or hydrogen peroxidesulfuric acid etchant or an alkaline ammoniacal etching solution. The etchants attack the copper where the metal surface is not protected by the resist. As the etching proceeds the resist-covered copper circuit pattern stands out in vertical relief. As the depth of the etch increases the sides of the copper supporting the resist are exposed to the etching solution and can be undercut resulting in circuit lines which do not have the designed cross-sectional area. This can cause problems in boards where impedance is tightly controlled.

Cupric chloride alkaline ammoniacal etchants are the ones most widely used commercially because of the high etch rates which they provide. A major drawback of this type of etchant is that the waste therefrom is difficult and expensive to treat and, since most etchant baths are operated on a feed and bleed type system, large volumes of such waste are generated. Electrolytic attempts to recycle or regenerate such baths have been largely unsuccessful due to the corrosive nature of the material and the large amounts of chlorine gas which are generated.

Cupric sulfate alkaline ammoniacal etchants do not pose such waste treatment problems and are easily regenerated using electrolytic regenerating techniques. However, they have such low etch rates, compared with the cupric chloride etchants, that they are not commercially feasible. The present invention is directed to improving dramatically the etch rate of these baths.

Various means of increasing the etch rate of copper etchants have been reported in the prior art. Illustratively, Saubestre U.S. Pat. No. 2,982,625 that the etch rate of a chromic acid-sulfuric acid bath containing a peroxysulfate is increased by the addition thereto of small amounts (0.05 to 5 g. per liter) of silver nitrate. Etching times for 2.8 mils thickness of copper were reported to be of the order of 17 minutes, i.e. 0.16 mil/-minute.

Dutkewych et al. U.S. Pat. No. 4,144,119 describes the use of a combination of hydrogen peroxide and a molybdenum compound as a rate enhancer for a sulfuric acid etchant bath. Allan et al. U.S. Pat. No. 4,158,593 teaches the use of a catalytic amount of a selenium compound (selenium dioxide) and a secondary or tertiary alcohol to increase the etching rate and performance of a sulfuric acid-hydrogen peroxide bath.

Sykes U.S. Pat. No. 4,311,551 deals with alkaline ammoniacal copper etching baths and teaches the use as accelerating additives of cyanamide and precursors thereof including thiourea and dithiobiurea. The copper is present in the bath as a cupric salt which can include the chloride, nitrate, acetate, carbonate and ammonium sulfate. However the chloride is the salt employed in all the Examples and the etchant baths of the latter are all subject to the disadvantages described above.

Fürst et al. U.S. Pat. No. 4,564,428 is concerned with alkaline ammonium sulfate copper etchant baths and describes the use of small amounts (0.05–0.4% w/w of chloride ion) of ammonium chloride to the regeneration time of the bath. Regeneration is achieved by bubbling oxygen through the bath. The amount of chloride ion introduced in this manner is said not to be a problem as far as generation of chlorine upon electrolytic recovery of the copper. A companion case, U.S. Pat. No. 4,557,811, describes the regeneration and recycling of the etchant baths of the '428 patent.

SUMMARY OF THE INVENTION

It is an object of the invention to improve the rate of etching exhibited by an alkaline ammoniacal copper sulfate etchant for copper and copper alloys.

It is a further object of the invention to improve the rate of etching exhibited by an alkaline ammoniacal copper sulfate etchant for copper and copper alloys without compromising the ease of recycling of said etchant and recovering copper metal therefrom.

It is yet another object of the invention to so improve the rate at which etching of copper and copper alloys can be achieved using an alkaline ammoniacal copper sulfate etchant that the latter can be employed as a commercially viable alternative to etchants which pose environmental problems in regard to disposal of wastes and or recovery of copper metal therefrom.

These objects, and other objects which will become apparent from the description which follows, are achieved by the process and compositions of the invention. Thus, in one aspect, the invention comprises improved etchants for copper and copper alloys which comprise an alkaline ammoniacal copper salt solution and an etchant accelerating amount of a mixture comprising an ammonium halide, a water-soluble salt containing sulfur, selenium or tellurium in the anion, an organic thio compound containing the grouping $$NH_2-\overset{\overset{\displaystyle S}{\|}}{C}-NH-$$

and, optionally, a water-soluble salt of a noble metal.

The invention also comprises a method of etching copper and copper alloys using the compositions of the invention. In a particular aspect, the invention comprises a method of etching away copper and copper alloys from the exposed areas of a copper clad substrate on which photoresist images of circuit patterns have been formed as a step in the fabrication of printed circuit boards.

DETAILED DESCRIPTION OF THE INVENTION

The etchants of the invention comprise an alkaline ammoniacal copper sulfate bath to which has been added a mixture of particular additives which in combination serve to accelerate the rate of etching of copper and copper alloys using the etchant.

Alkaline ammoniacal copper sulfate etchants are well-known in the art. They generally comprise an aqueous solution containing cupric sulfate, ammonium sulfate or like non-halogen containing ammonium salts, and sufficient ammonium hydroxide to adjust the pH of the solution to a value in the range of 8.0 to about 10.0 and preferably about 8.5 to 9.5. In general it is found that the copper dissolution rates of such etchants when operated at temperatures of about 120° F. are of the order of about 0.7 mils/minute to about 0.8 mils/minute. These rates compare unfavorably with those which can be achieved using cupric chloride based ammoniacal etchants. The latter have etching rates of the order of 2–3 mils/minute and therefore are preferred for commercial operations in spite of the problems discussed above which are associated with the recycling and waste treatment thereof.

It has now been found that, by use of a particular combination of additives as described below, it is possible to increase the copper dissolution rates of alkaline ammoniacal copper sulfate etchants by as much as about 100% thereby rendering the use of these etchants commercially feasible without, at the same time, derogating from the advantages which they possess in terms of ease of recycling in an environmentally acceptable manner.

As set forth above, the combination of additives in question comprises a mixture of (a) an ammonium halide, (b) a water-soluble salt containing sulfur, selenium or tellurium in the anion, and (c) an organic thio compound containing the group $$NH_2-\overset{\overset{\displaystyle S}{\|}}{C}-NH-.$$

An optional component of the mixture is a water soluble salt of a noble metal.

The term "ammonium halide" which is employed to define component (a) is inclusive of ammonium chloride, ammonium bromide, ammonium fluoride and amminium iodide.

The term "a water-soluble salt containing sulfur, selenium or tellurium in the anion" which is employed to define component (b) means a water-soluble metal or ammonium salt of sulfurous, sulfonic, selenious or telluric acids. Illustrative of such salts are sodium sulfite, sodium selenite, potassium selenite, sodium telluride, ammonium selenite, and the like.

The term "an organic thio compound containing the grouping $$NH_2-\overset{\overset{\displaystyle S}{\|}}{C}-NH-"$$

which is employed to define component (c) is inclusive of thiourea, dithiobiuret, dithiobiourea and the like.

The term "noble metal" is inclusive of silver, gold, platinum and palladium. Illustrative of the water-soluble salts thereof are the nitrate, halide, bromate, carbonate, cyanide or phosphate and the like.

The relative proportions of the individual components employed in the aforesaid combination of rate accelerating additives can vary over a wide range without affecting significantly the overall rate accelerating activity of the combination itself. Thus the ammonium halide can be employed in an amount within the range of about 0.5 g to 5 g per liter based on the overall volume of the total etchant bath. It is to be noted that this amount of halide can be introduced into the etchant bath without giving rise to any significant generation of halogen during electrolysis of the bath to recover copper therefrom during recycling and regeneration. Preferably the ammonium halide is employed in an amount corresponding to about 4 g to about 5 g per liter. Component (b) is employed advantageously in an amount from about 0.001 g to about 0.02 g per liter of etchant bath and preferably about 0.004 g to about 0.01 g per liter. Component (c) is also employed advantageously in the range of about 0.001 g to about 0.02 g per liter and preferably about 0.004 g to about 0.01 g per liter. Compound (d), if present in the admixture, is employed advantageously in an amount corresponding to about 0.001 g to about 0.02 g per liter of etchant solution and preferably from about 0.004 g to about 0.01 g per liter.

In a particularly preferred embodiment of the invention all four of the above components are employed and are present in the following proportions expressed in gms per liter of etchant solution.

TABLE I

| Component | Amount |
|---|---|
| (a) | 4 to 5 |
| (b) | 0.004 to 0.01 |
| (c) | 0.004 to 0.01 |
| (d) | 0.004 to 0.01 |

The amount of the combination of components (a), (b), (c) and optionally (d) which is employed in the etchant baths of the invention is referred to hereinafter as an "etchant rate accelerating amount". By this term is meant an amount of the combination of stated additives sufficient to increase the rate of etching of the etchant solution by at least 50 percent as compared with the rate for the same etchant free from the combination of additives. The amount of the combination of additives required to achieve this result in any given instance will vary depending upon the particular etchant bath and the nature of the particular combination of additives employed. The amount in question can be readily determined in any given instance by a process of trial and error. Similarly the amount of the combination of additives and the proportions of the individual components thereof necessary to achieve the optimum rate acceleration in any given instance can also be determined by a process of trial and error.

A particular combination of rate accelerating additives employed in the etchant baths of the invention comprises a mixture of ammonium chloride as component (a), sodium or potassium selenite as component (b), dithiobiuret as component (c) and silver nitrate as component (d) the proportions of these components in the mixture being within the range of the particularly preferred proportions set forth in Table I above.

The etchant baths of the invention can be employed in the etching of copper and copper alloys in a wide variety of applications for which such baths are conventionally employed in the art. In a particular embodiment the etchant baths of the invention are employed in the fabrication of printed circuit boards using operating conditions and procedures conventional in the art. Such boards are generally prepared by a series of steps which include producing a photoresist image of the desired circuit pattern on one or both sides of a copper clad non-conducting substrate followed by etching away the copper in the portions of the board not covered by the photoresist. The etching is carried out by immersion of the board in the etchant bath or spraying the board with the etchant solution. It is found that the etchant baths of the invention produce excellent results in this process and give rise to copper circuit patterns which have high resolution and which are substantially free from undercutting.

The following examples illustrate specific embodiments of the compositions and process of the invention and the best mode currently known to the inventors of carrying out the same but are not to be construed as limiting.

EXAMPLES 1–9

A series of etchant baths was prepared using combinations of one or more of the etchant rate accelerating additives listed in the Table II below in the proportions shown, all proportions being in gms per liter of etchant solution. The basic aqueous etchant bath solution before addition of the various additives contained 85 gms per liter of cupric ions present as cupric sulfate, ammonium sulfate in an amount such that the total sulfate ion concentration was 170 gms per liter and ammonium hydroxide in an amount to give a pH of 8.5–9.5. The rate of etching for each of the solutions shown in the Table I was determined by a standard procedure which was carried out as follows:

A sheet of copper of known surface area is weighed, then sent through the spray etcher containing the specific etchant in question. Time spent in the etching chamber is measured and the copper sheet is reweighed. Using this weight loss, time in the etching chamber, total surface area of the copper and the copper density, an etch rate is determined in mils of copper etched per minute.

TABLE II

| | Example | | | | | | | | |
|---|---|---|---|---|---|---|---|---|---|
| Additive | 1 | 2 | 3 | 4 | 5 | 6 | 7 | 8 | 9 |
| | (no additive) | | | | | | | | |
| Ammonium Chloride | — | 4 | 4 | 4 | 4 | 4 | 4 | — | — |
| Silver Nitrate | — | — | .006 | — | — | — | .004 | — | — |
| Sodium Selenite | — | — | — | — | .004 | .004 | .004 | .004 | .004 |
| Dithiobiuret | — | — | — | .004 | .004 | — | .004 | — | .004 |
| Etch rate mil/min. | .75 | .94 | 1.20 | 1.05 | 1.45 | 1.08 | 1.499 | .90 | .98 |

The etching rates so determined are expressed as mils thickness of copper sheet dissolved per minute in the test.

It will be seen from the above data that the rate of etching achieved using a combination of ammonium chloride, sodium selenite and dithiobiuret (Example 5) was about 93% greater than the etchant bath without additives (Example 1) or the various baths with the additives in question present singly (Examples 2 and 8) or in pairs (Examples 4 and 6). The highest increase in rate of etching was 99% achieved in Example 7 with all four additives in combination.

What is claimed is:

1. An etchant for copper and copper alloys which comprises an alkaline ammoniacal copper salt solution and an etchant accelerating amount of a mixture comprising an ammonium halide, a water-soluble salt containing sulfur, selenium or tellurium in the anion, and an organic thio compound containing the group $$NH_2-\overset{\overset{\displaystyle S}{\|}}{C}-NH-.$$

2. An etchant according to claim 1 wherein said mixture also comprises a water-soluble salt of a noble metal.

3. An etchant according to claim 1 wherein said copper salt is copper sulfate.

4. An etchant according to claim 1 having a pH in the range of 8.0 to 10.0.

5. An etchant according to claim 1 wherein said ammonium halide is present in an amount in the order of 0.5 g to 5 g per liter of etchant, said water-soluble salt is present in an amount to provide from 0.001 g to 0.02 g per liter of etchant of sulfur, selenium or tellurium and said organic thio compound is present in an amount in the range of about 0.001 g to 0.02 g per liter of etchant.

6. An etchant according to claim 1 which also comprises a water-soluble salt of a noble metal in an amount sufficient to provide from 0.001 g to 0.02 g per liter of etchant of the anion of said metal.

7. An etchant according to claim 1 wherein said ammonium halide is ammonium chloride.

8. An etchant according to claim 1 wherein said water soluble salt is an metal salt of selenious acid.

9. An etchant according to claim 1 wherein said organic thio compound is dithiobiuret or thiourea.

10. An etchant for copper and copper alloys which comprises an alkaline ammoniacal copper sulfate solution and an etchant accelerating amount of a mixture comprising an ammonium halide, an alkali metal selenite and a thio compound selected from thiourea, dithiobiuret and dithiobiurea.

11. An etchant according to claim 10 wherein said mixture also comprises silver nitrate.

12. An etchant according to claim 10 wherein said ammonium halide is present in an amount from 0.5 to 5 g per liter of etchant.

13. An etchant according to claim 10 wherein said alkali metal selenite is present in an amount such that there is from about 0.001 g to 0.02 g of selenium per liter of etchant.

14. An etchant according to claim 10 wherein said thio compound is present in an amount in the range of about 0.001 g to 0.02 g per liter of etchant.

15. An etchant according to claim 11 wherein said silver nitrate is present in an amount to provide from about 0.001 g to 0.02 g per liter of silver anion.

16. An etchant for copper and copper alloys in the form of an aqueous solution comprising from about 100 to about 400 g per liter of copper sulfate, ammonium hydroxide in an amount sufficient to provide a pH in the range of about 8.5 to 9.5, from about 0.5 to 5 g per liter of an ammonium halide, from about 0.001 g to 0.02 g per liter of sulfur, selenium or tellurium in the form of a water-soluble salt in which said sulfur, selenium or tellurium is present in the anion, from 0.001 g to 0.02 g per liter of an organic thio compound containing the grouping $$NH_2-\overset{\overset{\displaystyle S}{\|}}{C}-NH-,$$

and from 0 to 0.2 g of a water-soluble salt of a noble metal.

17. An etchant according to claim 16 wherein said ammonium halide is ammonium chloride.

18. An etchant according to claim 16 wherein said water-soluble salt having sulfur, selenium or tellurium in the anion is an alkali metal salt.

19. An etchant according to claim 18 wherein said water-soluble salt is an alkali metal selenite.

20. An etchant according to claim 16 wherein said thio compound is dithiobiuret.

21. An etchant according to claim 16 wherein said water-soluble salt of a noble metal is silver nitrate.

22. An etchant for copper and copper alloys which comprises an alkaline ammoniacal copper salt solution and an etchant accelerating amount of a mixture comprising ammonium chloride, an alkali mixture comprising ammonium chloride, an alkali metal selenite, dithiobiuret and silver nitrate.

23. In a process for etching copper and copper alloys using an alkaline ammoniacal copper salt solution as etchant the improvement comprising incorporating into said etchant an etchant accelerating amount of a mixture comprising an ammonium halide, a water-soluble salt containing sulfur, selenium or tellurium in the anion, and an organic thio compound containing the group $$NH_2-\overset{\overset{\displaystyle S}{\|}}{C}-NH-.$$

24. A process according to claim 23 wherein said mixture also comprises a water-soluble salt of a noble metal.

25. A process according to claim 23 wherein said copper salt is copper sulfate.

26. A process according to claim 23 wherein the pH of the etchant solution is in the range of 8.0 to 10.0.

27. A process according to claim 23 wherein said ammonium halide is present in an amount of the order of 0.5 g to 5 g per liter of etchant, said water-soluble salt is present in an amount to provide from 0.001 g to 0.02 g per liter of etchant of sulfur, selenium or tellurium and said organic thio compound is present in an amount in the range of about 0.001 g to 0.02 g per liter of etchant.

28. A process according to claim 24 wherein said salt of a noble metal is present in an amount sufficient to provide from 0.001 g to 0.02 g per liter of etchant of the anion of said metal.

29. A process according to claim 23 wherein said ammonium halide is ammonium chloride.

30. A process according to claim 23 wherein said water soluble salt is an alkali metal salt of selenious acid.

31. A process according to claim 23 wherein said organic thio compound is dithiobiuret or thiourea.

32. A process according to claim 23 wherein the copper being etched is that in the exposed areas of a copper clad substrate on which photoresist images of circuit patterns have been formed as a step in the fabrication of printed circuit boards.

* * * * *